US010877392B2

(12) United States Patent
Tzomik et al.

(10) Patent No.: US 10,877,392 B2
(45) Date of Patent: Dec. 29, 2020

(54) HEAT TRANSFER PRINTING

(71) Applicant: HP Indigo B.V., Amstelveen (NL)

(72) Inventors: Inna Tzomik, Modiin (IL); Hannoch Ron, Kadima (IL); Daniel Skvirsky, Nes Ziona (IL); Raia Slivniak, Lod (IL); Gleb Romantcov, Nes Ziona (IL)

(73) Assignee: HP Indigo B.V., Amstelveen (NL)

( * ) Notice: Subject to any disclaimer, the term of this patent is extended or adjusted under 35 U.S.C. 154(b) by 319 days.

(21) Appl. No.: 15/752,223

(22) PCT Filed: Oct. 23, 2015

(86) PCT No.: PCT/EP2015/074605
§ 371 (c)(1),
(2) Date: Feb. 12, 2018

(87) PCT Pub. No.: WO2017/067606
PCT Pub. Date: Apr. 27, 2017

(65) Prior Publication Data
US 2019/0121279 A1 Apr. 25, 2019

(51) Int. Cl.
*G03G 13/10* (2006.01)
*G03G 15/10* (2006.01)
(Continued)

(52) U.S. Cl.
CPC ..... *G03G 13/10* (2013.01); *G03G 15/10* (2013.01); *G03G 15/6585* (2013.01); *B41M 2205/10* (2013.01); *B44C 1/1712* (2013.01)

(58) Field of Classification Search
CPC ..... G03G 13/10; G03G 15/10; G03G 15/169; G03G 15/6585; B44C 1/1708; B44C 1/172
(Continued)

(56) References Cited

U.S. PATENT DOCUMENTS 3,819,368 A * 6/1974 Luebbe, Jr. ..... G03G 13/14 430/40
4,387,129 A 6/1983 Vincent
(Continued)

FOREIGN PATENT DOCUMENTS

CN 1555318 12/2004
CN 103476882 12/2013
(Continued)

OTHER PUBLICATIONS

Diamond, Arthur S. (ed.) Handbook of Imaging Materials. New York: Marcel-Dekker, Inc. pp. 239-247, 254-257. (Year: 2001).*
(Continued)

*Primary Examiner* — Christopher D Rodee
(74) *Attorney, Agent, or Firm* — Dierker & Kavanaugh PC

(57) ABSTRACT

There is provided a process for heat transfer printing, comprising electrostatically printing a transparent electrostatic ink composition (3) onto a transfer material (2), wherein the transparent electrostatic ink composition comprises a thermoplastic resin; printing an image (4) on the transparent electrostatic ink composition; contacting the image with a target substrate (1) under conditions such that the thermoplastic resin of the transparent electrostatic ink composition is softened or molten, and separating the target substrate and the transfer material, to leave the target substrate having thereon the image and an overlying layer of transparent electrostatic ink composition. Also disclosed is a fabric having thereon an image, the image having an overlying layer of transparent electrostatic ink composition.

9 Claims, 1 Drawing Sheet

(51) Int. Cl.
*G03G 15/00* (2006.01)
*B44C 1/17* (2006.01)

(58) Field of Classification Search
USPC ..... 430/40
See application file for complete search history.

(56) References Cited

U.S. PATENT DOCUMENTS

| | | | | |
|---|---|---|---|---|
| 4,762,764 | A | 8/1988 | Ng et al. | |
| 4,968,063 | A | 11/1990 | McConville et al. | |
| 5,546,114 | A | 8/1996 | Tait et al. | |
| 6,218,066 | B1 * | 4/2001 | Zhao | G03G 9/09758 430/114 |
| 6,221,545 | B1 | 4/2001 | Tran et al. | |
| 6,335,136 | B1 * | 1/2002 | Pan | G03G 9/135 399/251 |
| 6,468,637 | B1 | 10/2002 | Kwasny et al. | |
| 6,509,128 | B1 | 1/2003 | Everaerts et al. | |
| 7,592,117 | B2 * | 9/2009 | Jackson | G03G 15/1625 430/117.1 |
| 7,854,987 | B2 | 12/2010 | Jaipuria | |
| 10,620,570 | B2 * | 4/2020 | Tzomik | G03G 15/6585 |
| 2002/0047889 | A1 | 4/2002 | Springett et al. | |
| 2003/0118801 | A1 | 6/2003 | Miller et al. | |
| 2003/0230209 | A1 | 12/2003 | Gonzalez et al. | |
| 2005/0054780 | A1 | 3/2005 | Zhou et al. | |
| 2007/0253751 | A1 | 11/2007 | Thaler | |
| 2008/0241723 | A1 | 10/2008 | Kmiecik-Lawrynowicz | |
| 2008/0248261 | A1 | 10/2008 | Bonnett et al. | |
| 2011/0123228 | A1 | 5/2011 | Roditi | |
| 2013/0004742 | A1 | 1/2013 | La Costa | |
| 2013/0202860 | A1 | 8/2013 | Wei et al. | |
| 2014/0093706 | A1 | 4/2014 | Tzornik et al. | |
| 2014/0370252 | A1 | 12/2014 | Regnier | |
| 2015/0220010 | A1 | 8/2015 | Grinwald et al. | |
| 2015/0227064 | A1 | 8/2015 | Bandris et al. | |
| 2017/0329270 | A1 | 11/2017 | Ron et al. | |
| 2018/0229475 | A1 | 8/2018 | Tzomik et al. | |

FOREIGN PATENT DOCUMENTS

| | | |
|---|---|---|
| CN | 104853915 | 8/2015 |
| CN | 107209464 | 9/2017 |
| GB | 1291841 | 10/1972 |
| JP | 02155692 | 6/1990 |
| JP | H11034215 | 9/1999 |
| JP | 200553109 | 3/2005 |
| JP | 2008175888 | 7/2008 |
| JP | 2014133954 | 7/2014 |
| JP | 2014153646 | 8/2014 |
| JP | 2015529835 | 10/2015 |
| WO | WO 01/79318 | 10/2001 |
| WO | WO 2014/067578 | 5/2014 |
| WO | WO 2014/206494 | 12/2014 |
| WO | WO 2014206492 | 12/2014 |
| WO | WO 2015/110173 | 7/2015 |

OTHER PUBLICATIONS

International Search Report and Written Opinion for International Application No. PCT/EP2015/074605 dated Aug. 4, 2016, 13 pages.

* cited by examiner

HEAT TRANSFER PRINTING

BACKGROUND

Heat transfer printing (also known as thermal transfer printing) is the process of transferring images from one substrate to another by the application of heat. The image may first be applied onto a first substrate, for example, a polymeric film, this image then being brought into contact with a target substrate, e.g. a fabric, and heated. The target substrate and the first substrate may then be separated, leaving the image (in reverse) on the target substrate.

DETAILED DESCRIPTION

Figure 1A:
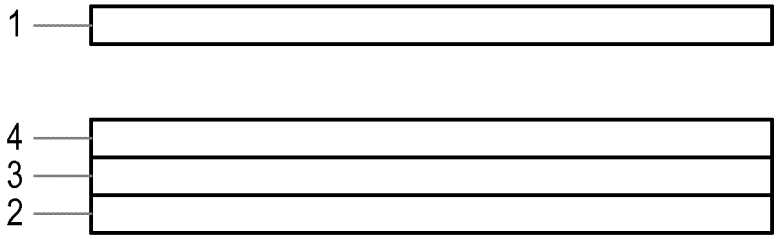
FIGS. 1A, 1B and 1C show, schematically, an example of a process for heat transfer printing, as disclosed herein.

Before the heat transfer printing and related aspects are disclosed and described, it is to be understood that this disclosure is not limited to the particular process steps and materials disclosed herein because such process steps and materials may vary somewhat. It is also to be understood that the terminology used herein is used for the purpose of describing particular examples only. The terms are not intended to be limiting because the scope of the present disclosure is intended to be limited by the appended claims and equivalents thereof.

It is noted that, as used in this specification and the appended claims, the singular forms "a," "an," and "the" include plural referents unless the context clearly dictates otherwise.

As used herein, "liquid carrier", "carrier liquid," "carrier," or "carrier vehicle" refers to the fluid in which the polymers, particles, colorant, charge directors and other additives can be dispersed to form a liquid electrostatic ink or electrophotographic ink. Such carrier liquids and vehicle components are known in the art. Typical carrier liquids can include a mixture of a variety of different agents, such as surfactants, co-solvents, viscosity modifiers, and/or other possible ingredients.

As used herein, "electrostatic ink composition" generally refers to an ink composition that is typically suitable for use in an electrostatic printing process, sometimes termed an electrophotographic printing process. The electrostatic ink composition, when printing, may include chargeable particles of the resin and, if present, the pigment dispersed in a liquid carrier, which may be as described herein. A transparent electrostatic ink composition may be an electrostatic ink composition that lacks a colorant (e.g. a pigment). An electrostatic ink composition for forming an image layer, in contrast, may contain a colorant. A colorant may be a species that imparts a colour to the ink, e.g. a colour selected from a magenta, cyan, yellow and black.

As used herein, "copolymer" refers to a polymer that is polymerized from at least two monomers.

A certain monomer may be described herein as constituting a certain weight percentage of a polymer. This indicates that the repeating units formed from the said monomer in the polymer constitute said weight percentage of the polymer.

If a standard test is mentioned herein, unless otherwise stated, the version of the test to be referred to is the most recent at the time of filing this patent application.

As used herein, "electrostatic printing" or "electrophotographic printing" generally refers to the process that provides an image that is transferred from a photo imaging substrate either directly, or indirectly via an intermediate transfer member, to a print substrate. As such, the image is not substantially absorbed into the photo imaging substrate on which it is applied. Additionally, "electrophotographic printers" or "electrostatic printers" generally refer to those printers capable of performing electrophotographic printing or electrostatic printing, as described above. "Liquid electrophotographic printing" is a specific type of electrophotographic printing where a liquid ink is employed in the electrophotographic process rather than a powder toner. An electrostatic printing process may involve subjecting the electrostatic ink composition to an electric field, e.g. an electric field having a field gradient of 1000 V/cm or more, or in some examples 1500 V/cm or more.

As used herein, in the context of the electrostatic ink composition, the term "transparent" may means having no or substantially no colorant or pigment.

As used herein, the term "about" is used to provide flexibility to a numerical range endpoint by providing that a given value may be "a little above" or "a little below" the endpoint. The degree of flexibility of this term can be dictated by the particular variable and would be within the knowledge of those skilled in the art to determine based on experience and the associated description herein.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 wt % to about 5 wt %" should be interpreted to include not only the explicitly recited values of about 1 wt % to about 5 wt %, but also include individual values and subranges within the indicated range. Thus, included in this numerical range are individual values such as 2, 3.5, and 4 and sub-ranges such as from 1-3, from 2-4, and from 3-5, etc. This same principle applies to ranges reciting only one numerical value. Furthermore, such an interpretation should apply regardless of the breadth of the range or the characteristics being described.

Unless otherwise stated, any feature described herein can be combined with any aspect or any other feature described herein.

In an aspect, there is provided a process for heat transfer printing. The process may comprise:

- electrostatically printing a transparent electrostatic ink composition onto a transfer material, wherein the transparent electrostatic ink composition comprises a thermoplastic resin;
- and then, in some examples, printing an image on the transparent electrostatic ink composition;
- contacting the image with a target substrate under conditions such that the thermoplastic resin of the transparent electrostatic ink composition is softened or molten, and separating the target substrate and the transfer material, to leave the target substrate having thereon the image and an overlying layer of transparent electrostatic ink composition. In an aspect, there is provided a target substrate produced by the process for transfer printing.

In an aspect, there is provided a fabric having thereon an image, the image having an overlying layer of transparent electrostatic ink composition, the electrostatic ink composition comprising a thermoplastic resin and a charge director and/or a charge adjuvant. The fabric having thereon an image, the image having an overlying layer of transparent electrostatic ink composition may have been produced according to a process for heat transfer printing as described herein, with the fabric being the target substrate.

Figure 1B:
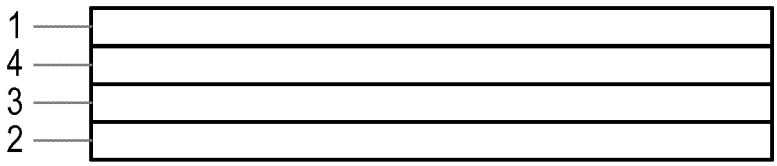
Figure 1C:
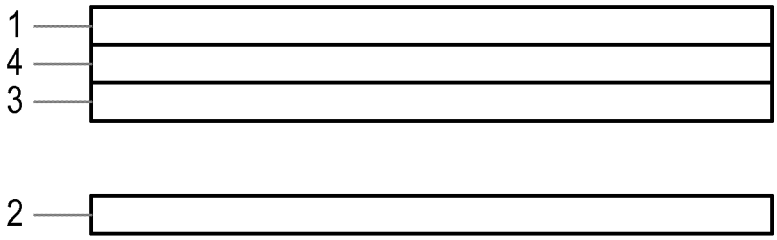

FIGS. 1A, 1B and 10 show, schematically, an example of a process for heat transfer printing, as disclosed herein. FIG. 1A shows a transfer material (2) having printed thereon a transparent electrostatic ink composition (3), which, in turn, has printed thereon an image layer (4). Both the transparent electrostatic ink composition (3) and the image layer (4) may have been printed by an electrostatic printing process. FIG. 1A also shows a target substrate (1), separated from the transfer material (2) having printed thereon a transparent electrostatic ink composition (3) and the image layer 4.

In FIG. 1B, the target substrate (1) has been brought into contact with the image layer (4). Heat is applied to soften or melt the thermoplastic resin of the transparent electrostatic ink composition (3).

In FIG. 10, the target substrate and transfer material have been separated, leaving the target substrate having thereon the image layer (4) and an overlying layer of transparent electrostatic ink composition (3).

Transparent Electrostatic Ink Composition

The transparent electrostatic ink composition comprises a thermoplastic resin. It may further comprise a charge adjuvant and/or a charge director. The transparent electrostatic ink composition does not contain any pigment, or comprises substantially lacks pigment and thus is a pigment-free composition. The transparent electrostatic ink composition may otherwise be termed a colourless electrostatic ink composition or a colorless varnish for digital printing. The transparent electrostatic ink composition may comprise less than 5 wt % solids of colorant, in some examples less than 3 wt % solids of colorant, in some examples less than 1 wt % solids of colorant. "Colorant" may be a material that imparts a color to the ink composition. As used herein, "colorant" includes pigments and dyes, such as those that impart colors such as black, magenta, cyan and yellow to an ink. As used herein, "pigment" generally includes pigment colorants, magnetic particles, aluminas, silicas, and/or other ceramics or organo-metallics. Thus, though the present description primarily exemplifies the use of pigment colorants, the term "pigment" can be used more generally to describe not only pigment colorants, but other pigments such as organometallics, ferrites, ceramics, etc.

The thermoplastic resin may constitute at least 85 wt % of the solids of the transparent electrostatic ink composition, in some examples at least 90 wt % solids of the solids of the transparent electrostatic ink composition, in some examples 95, wt % of the solids of the transparent electrostatic ink composition.

If a solid polar compound is present, the thermoplastic resin and the solid polar compound together may constitute at least 85 wt % of the solids of the transparent electrostatic ink composition, in some examples at least 90 wt % of the solids of the transparent electrostatic ink composition, in some examples 95, wt % of the solids of the transparent electrostatic ink composition.

The transparent electrostatic ink composition may further comprise at least one additive such as surfactants, viscosity modifiers, emulsifiers and the like.

In some examples, once printed, the transparent electrostatic ink composition forms a layer of less than 10 μm in thickness, for example less than 9 μm in thickness, less than 8 μm in thickness, less than 7 μm in thickness, less than 6 μm in thickness, less than 5 μm in thickness, less than 4 μm in thickness, less than 3 μm in thickness, less than 2 μm in thickness, less than 1.5 μm in thickness. In some examples, the transparent electrostatic ink composition is about 1 μm in thickness.

In some examples, once printed, the transparent electrostatic ink composition forms a layer greater than 0.1 μm in thickness, for example greater than 0.2 μm in thickness, greater than 0.3 μm in thickness, greater than 0.4 μm in thickness, greater than 0.5 μm in thickness, greater than 0.6 μm in thickness, greater than 0.7 μm in thickness, greater than 0.8 μm in thickness, greater than 0.9 μm in thickness. In some examples, the film of material is about 1 μm in thickness.

Liquid Carrier

In some examples, when printing, the transparent electrostatic ink composition comprises a liquid carrier. Generally, the liquid carrier can act as a dispersing medium for the other components in the electrostatic ink composition. For example, the liquid carrier can comprise or be a hydrocarbon, silicone oil, vegetable oil, etc. The liquid carrier can include, but is not limited to, an insulating, non-polar, non-aqueous liquid that can be used as a medium for toner particles. The liquid carrier can include compounds that have a resistivity in excess of about $10^9$ ohm-cm. The liquid carrier may have a dielectric constant below about 5, in some examples below about 3. The liquid carrier can include, but is not limited to, hydrocarbons. The hydrocarbon can include, but is not limited to, an aliphatic hydrocarbon, an isomerized aliphatic hydrocarbon, branched chain aliphatic hydrocarbons, aromatic hydrocarbons, and combinations thereof. Examples of the liquid carriers include, but are not limited to, aliphatic hydrocarbons, isoparaffinic compounds, paraffinic compounds, dearomatized hydrocarbon compounds, and the like. In particular, the liquid carriers can include, but are not limited to, Isopar-G™, Isopar-H™, Isopar-L™, Isopar-M™, Isopar-K™, Isopar-V™, Norpar12™, Norpar13™, Norpar15™, Exxol D40™, Exxol D80™, Exxol D100™, Exxol D130™, and Exxol D140™ (each sold by EXXON CORPORATION); Teclen N-16™, Teclen N-20™, Teclen N-22™, Nisseki Naphthesol L™, Nisseki Naphthesol M™, Nisseki Naphthesol H™, #0 Solvent L™, #0 Solvent M™, #0 Solvent H™, Nisseki Isosol300™ Nisseki Isosol400™ AF-4™, AF-5™, AF-6™ and AF-7™ (each sold by NIPPON OIL CORPORATION); IP Solvent1620™ and IP Solvent 2028™ (each sold by IDEMITSU PETROCHEMICAL CO., LTD.); Amsco OMS™ and Amsco460™ (each sold by AMERICAN MINERAL SPIRITS CORP.); and Electron, Positron, New II, Purogen HF (100% synthetic terpenes) (sold by ECOLINK™).

Before electrostatic printing, the liquid carrier can constitute about 20% to 99.5% by weight of the transparent electrostatic ink composition, in some examples 50% to 99.5% by weight of the transparent electrostatic ink composition. Before printing, the liquid carrier may constitute about 40 to 90% by weight of the transparent electrostatic ink composition. Before printing, the liquid carrier may constitute about 60% to 80% by weight of the transparent electrostatic ink composition. Before printing, the liquid carrier may constitute about 90% to 99.5% by weight of the transparent electrostatic ink composition, in some examples 95% to 99% by weight of the transparent electrostatic ink composition.

The ink, when electrostatically printed on the transfer material, may be substantially free from liquid carrier. In an electrostatic printing process and/or afterwards, the liquid carrier may be removed, e.g. by an electrophoresis processes during printing and/or evaporation, such that substantially just solids are transferred to the transfer material. Substantially free from liquid carrier may indicate that the ink printed on the transfer material contains less than 5 wt % liquid carrier, in some examples, less than 2 wt % liquid carrier, in some examples less than 1 wt % liquid carrier, in some examples less than 0.5 wt % liquid carrier. In some examples, the ink printed on the transfer material is free from liquid carrier.

Thermoplastic Resin

The transparent electrostatic ink composition includes a thermoplastic resin, referred to as the resin. A thermoplastic polymer is sometimes referred to as a thermoplastic resin.

The resin typically includes a polymer. The resin can include, but is not limited to, a thermoplastic polymer. In some examples, the polymer of the resin may be selected from ethylene acrylic acid copolymers; ethylene methacrylic acid copolymers; ethylene vinyl acetate copolymers; copolymers of ethylene (e.g. 80 wt % to 99.9 wt %), and alkyl (e.g. C1 to C5) ester of methacrylic or acrylic acid (e.g. 0.1 wt % to 20 wt %); copolymers of ethylene (e.g. 80 wt % to 99.9 wt %), acrylic or methacrylic acid (e.g. 0.1 wt % to 20.0 wt %) and alkyl (e.g. C1 to C5) ester of methacrylic or acrylic acid (e.g. 0.1 wt % to 20 wt %); polyethylene; polystyrene; isotactic polypropylene (crystalline); ethylene ethyl acrylate; polyesters; polyvinyl toluene; polyamides; styrene/butadiene copolymers; epoxy resins; acrylic resins (e.g. copolymer of acrylic or methacrylic acid and at least one alkyl ester of acrylic or methacrylic acid wherein alkyl is, in some examples, from 1 to about 20 carbon atoms, such as methyl methacrylate (e.g. 50 wt % to 90 wt %))/methacrylic acid (e.g. 0 wt % to 20 wt %))/ethylhexylacrylate (e.g. 10 wt % to 50 wt %)); ethylene-acrylate terpolymers: ethylene-acrylic esters-maleic anhydride (MAH) or glycidyl methacrylate (GMA) terpolymers; ethylene-acrylic acid ionomers and combinations thereof.

The resin may comprise a polymer having acidic side groups. The polymer having acidic side groups may have an acidity of 50 mg KOH/g or more, in some examples an acidity of 60 mg KOH/g or more, in some examples an acidity of 70 mg KOH/g or more, in some examples an acidity of 80 mg KOH/g or more, in some examples an acidity of 90 mg KOH/g or more, in some examples an acidity of 100 mg KOH/g or more, in some examples an acidity of 105 mg KOH/g or more, in some examples 110 mg KOH/g or more, in some examples 115 mg KOH/g or more. The polymer having acidic side groups may have an acidity of 200 mg KOH/g or less, in some examples 190 mg or less, in some examples 180 mg or less, in some examples 130 mg KOH/g or less, in some examples 120 mg KOH/g or less. Acidity of a polymer, as measured in mg KOH/g can be measured using standard procedures known in the art, for example using the procedure described in ASTM D1386.

The resin may comprise a polymer, in some examples a polymer having acidic side groups, that has a melt flow rate of less than about 60 g/10 minutes, in some examples about 50 g/10 minutes or less, in some examples about 40 g/10 minutes or less, in some examples 30 g/10 minutes or less, in some examples 20 g/10 minutes or less, in some examples 10 g/10 minutes or less. In some examples, all polymers having acidic side groups and/or ester groups in the particles each individually have a melt flow rate of less than 90 g/10 minutes, 80 g/10 minutes or less, in some examples 80 g/10 minutes or less, in some examples 70 g/10 minutes or less, in some examples 70 g/10 minutes or less, in some examples 60 g/10 minutes or less.

The polymer having acidic side groups can have a melt flow rate of about 10 g/10 minutes to about 120 g/10 minutes, in some examples about 10 g/10 minutes to about 70 g/10 minutes, in some examples about 10 g/10 minutes to 40 g/10 minutes, in some examples 20 g/10 minutes to 30 g/10 minutes. The polymer having acidic side groups can have a melt flow rate of in some examples about 50 g/10 minutes to about 120 g/10 minutes, in some examples 60 g/10 minutes to about 100 g/10 minutes. The melt flow rate can be measured using standard procedures known in the art, for example as described in ASTM D1238.

The acidic side groups may be in free acid form or may be in the form of an anion and associated with at least one counterion, typically metal counterions, e.g. a metal selected from the alkali metals, such as lithium, sodium and potassium, alkali earth metals, such as magnesium or calcium, and transition metals, such as zinc. The polymer having acidic sides groups can be selected from resins such as copolymers of ethylene and an ethylenically unsaturated acid of either acrylic acid or methacrylic acid; and ionomers thereof, such as methacrylic acid and ethylene-acrylic or methacrylic acid copolymers which are at least partially neutralized with metal ions (e.g. Zn, Na, Li) such as SURLYN® ionomers. The polymer comprising acidic side groups can be a copolymer of ethylene and an ethylenically unsaturated acid of either acrylic or methacrylic acid, where the ethylenically unsaturated acid of either acrylic or methacrylic acid constitute from 5 wt % to about 25 wt % of the copolymer, in some examples from 10 wt % to about 20 wt % of the copolymer.

The resin may comprise two different polymers having acidic side groups. The two polymers having acidic side groups may have different acidities, which may fall within the ranges mentioned above. The resin may comprise a first polymer having acidic side groups that has an acidity of from 50 mg KOH/g to 110 mg KOH/g and a second polymer having acidic side groups that has an acidity of 110 mg KOH/g to 130 mg KOH/g.

The resin may comprise two different polymers having acidic side groups: a first polymer having acidic side groups that has a melt flow rate of about 10 g/10 minutes to about 50 g/10 minutes and an acidity of from 50 mg KOH/g to 110 mg KOH/g, and a second polymer having acidic side groups that has a melt flow rate of about 50 g/10 minutes to about 120 g/10 minutes and an acidity of 110 mg KOH/g to 130 mg KOH/g. The first and second polymers may be absent of ester groups.

The resin may comprise two different polymers having acidic side groups: a first polymer that is a copolymer of ethylene (e.g. 92 to 85 wt %, in some examples about 89 wt %) and acrylic or methacrylic acid (e.g. 8 to 15 wt %, in some examples about 11 wt %) having a melt flow rate of 80 to 110 g/10 minutes and a second polymer that is a copolymer of ethylene (e.g. about 80 to 92 wt %, in some examples about 85 wt %) and acrylic acid (e.g. about 18 to 12 wt %, in some examples about 15 wt %), having a melt viscosity lower than that of the first polymer, the second polymer for example having a melt viscosity of 15000 poise or less, in some examples a melt viscosity of 10000 poise or less, in some examples 1000 poise or less, in some examples 100 poise or less, in some examples 50 poise or less, in some examples 10 poise or less. Melt viscosity can be measured using standard techniques. The melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 hz shear rate.

In any of the resins mentioned above, the ratio of the first polymer having acidic side groups to the second polymer having acidic side groups can be from about 10:1 to about 2:1. In another example, the ratio can be from about 6:1 to about 3:1, in some examples about 4:1.

The resin may comprise a polymer having a melt viscosity of 15000 poise or less, in some examples a melt viscosity of 10000 poise or less, in some examples 1000 poise or less, in some examples 100 poise or less, in some examples 50 poise or less, in some examples 10 poise or less; said polymer may be a polymer having acidic side groups as described herein. The resin may comprise a first polymer having a melt viscosity of 15000 poise or more, in some examples 20000 poise or more, in some examples 50000 poise or more, in some examples 70000 poise or more; and in some examples, the resin may comprise a second polymer having a melt viscosity less than the first polymer, in some examples a melt viscosity of 15000 poise or less, in some examples a melt viscosity of 10000 poise or less, in some examples 1000 poise or less, in some examples 100 poise or less, in some examples 50 poise or less, in some examples 10 poise or less. The resin may comprise a first polymer having a melt viscosity of more than 60000 poise, in some examples from 60000 poise to 100000 poise, in some examples from 65000 poise to 85000 poise; a second polymer having a melt viscosity of from 15000 poise to 40000 poise, in some examples 20000 poise to 30000 poise, and a third polymer having a melt viscosity of 15000 poise or less, in some examples a melt viscosity of 10000 poise or less, in some examples 1000 poise or less, in some examples 100 poise or less, in some examples 50 poise or less, in some examples 10 poise or less; an example of the first polymer is Nucrel 960 (from DuPont), and example of the second polymer is Nucrel 699 (from DuPont), and an example of the third polymer is AC-5120 (from Honeywell). The first, second and third polymers may be polymers having acidic side groups as described herein. The melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 hz shear rate.

If the resin comprises a single type of resin polymer, the resin polymer (excluding any other components of the electrostatic ink composition) may have a melt viscosity of 6000 poise or more, in some examples a melt viscosity of 8000 poise or more, in some examples a melt viscosity of 10000 poise or more, in some examples a melt viscosity of 12000 poise or more. If the resin comprises a plurality of polymers all the polymers of the resin may together form a mixture (excluding any other components of the electrostatic ink composition) that has a melt viscosity of 6000 poise or more, in some examples a melt viscosity of 8000 poise or more, in some examples a melt viscosity of 10000 poise or more, in some examples a melt viscosity of 12000 poise or more. Melt viscosity can be measured using standard techniques. The melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 hz shear rate.

The resin may comprise two different polymers having acidic side groups that are selected from copolymers of ethylene and an ethylenically unsaturated acid of either methacrylic acid or acrylic acid; and ionomers thereof, such as methacrylic acid and ethylene-acrylic or methacrylic acid copolymers which are at least partially neutralized with metal ions (e.g. Zn, Na, Li) such as SURLYN® ionomers. The resin may comprise (i) a first polymer that is a copolymer of ethylene and an ethylenically unsaturated acid of either acrylic acid and methacrylic acid, wherein the ethylenically unsaturated acid of either acrylic or methacrylic acid constitutes from 8 wt % to about 16 wt % of the copolymer, in some examples 10 wt % to 16 wt % of the copolymer; and (ii) a second polymer that is a copolymer of ethylene and an ethylenically unsaturated acid of either acrylic acid and methacrylic acid, wherein the ethylenically unsaturated acid of either acrylic or methacrylic acid constitutes from 12 wt % to about 30 wt % of the copolymer, in some examples from 14 wt % to about 20 wt % of the copolymer, in some examples from 16 wt % to about 20 wt % of the copolymer in some examples from 17 wt % to 19 wt % of the copolymer.

In an example, the thermoplastic resin constitutes about 10 to 99%, in some examples about 15 to 95%, by weight of the solids of the transparent electrostatic ink composition. In another example, the resin constitutes about 20 to 95% by weight of the solids of the transparent electrostatic ink composition. In another example, the resin constitutes about 25 to 95% by weight of the solids of the transparent electrostatic ink composition. In another example, the resin constitutes about 35 to 95% by weight, in some examples from 75 to 95% by weight, of the solids of the transparent electrostatic ink composition. In another example, the resin constitutes about 35 to 95% by weight, in some examples from 75 to 99% by weight, of the solids of the transparent electrostatic ink composition.

The thermoplastic resin may comprise a polymer having acidic side groups, as described above (which may be free of ester side groups), and a polymer having ester side groups. The polymer having ester side groups is, in some examples, a thermoplastic polymer. The polymer having ester side groups may further comprise acidic side groups. The polymer having ester side groups may be a co-polymer of a monomer having ester side groups and a monomer having acidic side groups. The polymer may be a co-polymer of a monomer having ester side groups, a monomer having acidic side groups, and a monomer absent of any acidic and ester side groups. The monomer having ester side groups may be a monomer selected from esterified acrylic acid or esterified methacrylic acid. The monomer having acidic side groups may be a monomer selected from acrylic or methacrylic acid. The monomer absent of any acidic and ester side groups may be an alkylene monomer, including, but not limited to, ethylene or propylene. The esterified acrylic acid or esterified methacrylic acid may, respectively, be an alkyl ester of acrylic acid or an alkyl ester of methacrylic acid. The alkyl group in the alkyl ester of acrylic or methacrylic acid may be an alkyl group having 1 to 30 carbons, in some examples 1 to 20 carbons, in some examples 1 to 10 carbons; in some examples selected from methyl, ethyl, iso-propyl, n-propyl, t-butyl, iso-butyl, n-butyl and pentyl.

The polymer having ester side groups may be a co-polymer of a first monomer having ester side groups, a second monomer having acidic side groups and a third monomer which is an alkylene monomer absent of any acidic and ester side groups. The polymer having ester side groups may be a co-polymer of (i) a first monomer having ester side groups selected from esterified acrylic acid or esterified methacrylic acid, in some examples an alkyl ester of acrylic or methacrylic acid, (ii) a second monomer having acidic side groups selected from acrylic or methacrylic acid and (iii) a third monomer which is an alkylene monomer selected from ethylene and propylene. The first monomer may constitute 1 to 50% by weight of the co-polymer, in some examples 5 to 40% by weight, in some examples 5 to 20% by weight of the copolymer, in some examples 5 to 15% by weight of the copolymer. The second monomer may constitute 1 to 50% by weight of the co-polymer, in some examples 5 to 40% by weight of the co-polymer, in some examples 5 to 20% by weight of the co-polymer, in some examples 5 to 15% by weight of the copolymer. In an example, the first monomer constitutes 5 to 40% by weight of the co-polymer, the second monomer constitutes 5 to 40% by weight of the co-polymer, and with the third monomer constituting the remaining weight of the copolymer. In an example, the first monomer constitutes 5 to 15% by weight of the co-polymer, the second monomer constitutes 5 to 15% by weight of the co-polymer, with the third monomer constituting the remaining weight of the copolymer. In an example, the first monomer constitutes 8 to 12% by weight of the co-polymer, the second monomer constitutes 8 to 12% by weight of the co-polymer, with the third monomer constituting the remaining weight of the copolymer. In an example, the first monomer constitutes about 10% by weight of the co-polymer, the second monomer constitutes about 10% by weight of the co-polymer, and with the third monomer constituting the remaining weight of the copolymer. The polymer having ester side groups may be selected from the Bynel® class of monomer, including Bynel 2022 and Bynel 2002, which are available from DuPont®.

The polymer having ester side groups may constitute 1% or more by weight of the total amount of the resin polymers in the resin, e.g. the total amount of the polymer or polymers having acidic side groups and polymer having ester side groups. The polymer having ester side groups may constitute 5% or more by weight of the total amount of the resin polymers in the resin, in some examples 8% or more by weight of the total amount of the resin polymers in the resin, in some examples 10% or more by weight of the total amount of the resin polymers in the resin, in some examples 15% or more by weight of the total amount of the resin polymers in the resin, in some examples 20% or more by weight of the total amount of the resin polymers in the resin, in some examples 25% or more by weight of the total amount of the resin polymers in the resin, in some examples 30% or more by weight of the total amount of the resin polymers in the resin, in some examples 35% or more by weight of the total amount of the resin polymers in the resin. The polymer having ester side groups may constitute from 5% to 50% by weight of the total amount of the resin polymers in the resin, in some examples 10% to 40% by weight of the total amount of the resin polymers in the resin, in some examples 15% to 30% by weight of the total amount of the polymers in the resin.

The polymer having ester side groups may have an acidity of 50 mg KOH/g or more, in some examples an acidity of 60 mg KOH/g or more, in some examples an acidity of 70 mg KOH/g or more, in some examples an acidity of 80 mg KOH/g or more. The polymer having ester side groups may have an acidity of 100 mg KOH/g or less, in some examples 90 mg KOH/g or less. The polymer having ester side groups may have an acidity of 60 mg KOH/g to 90 mg KOH/g, in some examples 70 mg KOH/g to 80 mg KOH/g.

The polymer having ester side groups may have a melt flow rate of about 10 g/10 minutes to about 120 g/10 minutes, in some examples about 10 g/10 minutes to about 50 g/10 minutes, in some examples about 20 g/10 minutes to about 40 g/10 minutes, in some examples about 25 g/10 minutes to about 35 g/10 minutes.

In an example, the polymer or polymers of the resin can be selected from the Nucrel family of toners (e.g. Nucrel 403™, Nucrel407™, Nucrel 609HS™, Nucrel 908HS™ Nucrel 1202HC™, Nucrel30707™ Nucrel1214™, Nucrel 903™, Nucrel 3990™ Nucrel910™, Nucrel925™, Nucrel699™, Nucrel599™, Nucrel960™, Nucrel RX 76™, Nucrel2806™, Bynell 2002, Bynell 2014, and Bynell 2020 (sold by E. I. du PONT)), the Aclyn family of toners (e.g. Aclyn 201, Aclyn 246, Aclyn 285, and Aclyn 295), and the Lotader family of toners (e.g. Lotader 2210, Lotader, 3430, and Lotader 8200 (sold by Arkema)).

Charge Director and Charge Adjuvant

In some examples, the transparent electrostatic ink composition includes either a charge director or a charge adjuvant or both.

The charge director may be added in order to impart and/or maintain sufficient electrostatic charge on ink particles during electrostatic printing, which may be particles comprising the thermoplastic resin. The charge director may comprise ionic compounds, particularly metal salts of fatty acids, metal salts of sulfo-succinates, metal salts of oxyphosphates, metal salts of alkyl-benzenesulfonic acid, metal salts of aromatic carboxylic acids or sulfonic acids, as well as zwitterionic and non-ionic compounds, such as polyoxyethylated alkylamines, lecithin, polyvinylpyrrolidone, organic acid esters of polyvalent alcohols, etc. The charge director can be selected from, but is not limited to, oil-soluble petroleum sulfonates (e.g. neutral Calcium Petronate™, neutral Barium Petronate™, and basic Barium Petronate™), polybutylene succinimides (e.g. OLOA™ 1200 and Amoco 575), and glyceride salts (e.g. sodium salts of phosphated mono- and diglycerides with unsaturated and saturated acid substituents), sulfonic acid salts including, but not limited to, barium, sodium, calcium, and aluminum salts of sulfonic acid. The sulfonic acids may include, but are not limited to, alkyl sulfonic acids, aryl sulfonic acids, and sulfonic acids of alkyl succinates. The charge director can impart a negative charge or a positive charge on the resin-containing particles of an electrostatic ink composition.

In some examples, the transparent electrostatic ink composition comprises a charge director comprising a simple salt. Simple salts are salts that do not form micelles by themselves, although they may form a core for micelles with a micelle forming salt. The ions constructing the simple salts are all hydrophilic. The simple salt may include a cation selected from the group consisting of Mg, Ca, Ba, NH4, tert-butyl ammonium, Li+, and Al+3, or from any sub-group thereof. The simple salt may include an anion selected from the group consisting of $SO_4^{2-}$, $PO^{3-}$, $NO^{3-}$, $HPO_4^{2-}$, $CO_3^{2-}$, acetate, trifluoroacetate (TFA), $Cl^-$, $BF_4^-$, $F^-$, $ClO_4^-$, and $TiO_3^{4-}$, or from any sub-group thereof. The simple salt may be selected from $CaCO_3$, $Ba_2TiO_3$, $Al_2(SO_4)$, $Al(NO_3)_3$, $Ca_3(PO_4)_2$, $BaSO_4$, $BaHPO_4$, $Ba_2(PO_4)_3$, $CaSO_4$, $(NH_4)_2CO_3$, $(NH_4)_{2504}$, $NH_4OAc$, Tert-butyl ammonium bromide, $NH_4NO_3$, LiTFA, $Al_2(SO_4)3$, $LiClO_4$ and $LiBF_4$, or any sub-group thereof.

The charge director may include at least one of (i) soya lecithin, (ii) a barium sulfonate salt, such as basic barium petronate (BPP), and (iii) an isopropyl amine sulfonate salt. Basic barium petronate is a barium sulfonate salt of a 21-26 hydrocarbon alkyl, and can be obtained, for example, from Chemtura. An example isopropyl amine sulphonate salt is dodecyl benzene sulfonic acid isopropyl amine, which is available from Croda.

In some examples, the transparent electrostatic ink composition comprises a charge director comprising a sulfosuccinate salt of the general formula MAn, wherein M is a metal, n is the valence of M, and A is an ion of the general formula (I):

$$[R^1—O—C(O)CH_2CH(SO_3)C(O)—O—R^2]^- \quad (I)$$

wherein each of $R^1$ and $R^2$ is an alkyl group.

The sulfosuccinate salt of the general formula MAn is an example of a micelle forming salt. The charge director may be substantially free or free of an acid of the general formula HA, where A is as described above. The charge director may include micelles of said sulfosuccinate salt enclosing at least some of the nanoparticles. The charge director may include at least some nanoparticles having a size of 200 nm or less, and/or in some examples 2 nm or more.

In the formula $[R_1—O—C(O)CH_2CH(SO_3)C(O)—O—R_2]$, in some examples each of $R_1$ and $R_2$ is an aliphatic alkyl group. In some examples, each of $R_1$ and $R_2$ independently is a C6-25 alkyl. In some examples, said aliphatic alkyl group is linear. In some examples, said aliphatic alkyl group is branched. In some examples, said aliphatic alkyl group includes a linear chain of more than 6 carbon atoms. In some examples, $R_1$ and $R_2$ are the same. In some examples, at least one of $R_1$ and $R_2$ is $C_{13}H_{27}$. In some examples, M is Na, K, Cs, Ca, or Ba.

In some examples, the charge director constitutes about 0.001% to 20%, in some examples 0.01% to 20% by weight, in some examples 0.01 to 10% by weight, in some examples 0.01% to 1% by weight of the solids of an transparent electrostatic ink composition. In some examples, the charge director constitutes about 0.001% to 0.15% by weight of the solids of the transparent electrostatic ink composition, in some examples 0.001% to 0.15%, in some examples 0.001% to 0.02% by weight of the solids of an transparent electrostatic ink composition, in some examples 0.1% to 2% by weight of the solids of the transparent electrostatic ink composition, in some examples 0.2% to 1.5% by weight of the solids of the transparent electrostatic ink composition in some examples 0.1% to 1% by weight of the solids of the transparent electrostatic ink composition, in some examples 0.2% to 0.8% by weight of the solids of the transparent electrostatic ink composition. In some examples, the charge director is present in an amount of at least 1 mg of charge director per gram of solids of the transparent electrostatic ink composition (which will be abbreviated to mg/g), in some examples at least 2 mg/g, in some examples at least 3 mg/g, in some examples at least 4 mg/g, in some examples at least 5 mg/g. In some examples, the charge director is present in the amounts stated above, and the charge director is present in an amount of from 1 mg to 50 mg of charge director per gram of solids of the transparent electrostatic ink composition (which will be abbreviated to mg/g), in some examples from 1 mg/g to 25 mg/g, in some examples from 1 mg/g to 20 mg/g, in some examples from 1 mg/g to 15 mg/g, in some examples from 1 mg/g to 10 mg/g, in some examples from 3 mg/g to 20 mg/g, in some examples from 3 mg/g to 15 mg/g, in some examples from 5 mg/g to 10 mg/g.

A charge adjuvant may promote charging of the particles when a charge director is present in the electrostatic ink composition during printing. The charge adjuvant can include, but is not limited to, barium petronate, calcium petronate, Co salts of naphthenic acid, Ca salts of naphthenic acid, Cu salts of naphthenic acid, Mn salts of naphthenic acid, Ni salts of naphthenic acid, Zn salts of naphthenic acid, Fe salts of naphthenic acid, Ba salts of stearic acid, Co salts of stearic acid, Pb salts of stearic acid, Zn salts of stearic acid, Al salts of stearic acid, Zn salts of stearic acid, Cu salts of stearic acid, Pb salts of stearic acid, Fe salts of stearic acid, metal carboxylates (e.g., Al tristearate, Al octanoate, Li heptanoate, Fe stearate, Fe distearate, Ba stearate, Cr stearate, Mg octanoate, Ca stearate, Fe naphthenate, Zn naphthenate, Mn heptanoate, Zn heptanoate, Ba octanoate, Al octanoate, Co octanoate, Mn octanoate, and Zn octanoate), Co lineolates, Mn lineolates, Pb lineolates, Zn lineolates, Ca oleates, Co oleates, Zn palmirate, Ca resinates, Co resinates, Mn resinates, Pb resinates, Zn resinates, AB diblock copolymers of 2-ethylhexyl methacrylate-co-methacrylic acid calcium and ammonium salts, copolymers of an alkyl acrylamidoglycolate alkyl ether (e.g., methyl acrylamidoglycolate methyl ether-co-vinyl acetate), and hydroxy bis(3,5-di-tert-butyl salicylic) aluminate monohydrate. In an example, the charge adjuvant is or includes aluminum di- or tristearate. The charge adjuvant may be present in an amount of about 0.1 to 5% by weight, in some examples about 0.1 to 1% by weight, in some examples about 0.3 to 0.8% by weight of the solids of the transparent electrostatic ink composition, in some examples about 1 wt % to 3 wt % of the solids of the transparent electrostatic ink composition, in some examples about 1.5 wt % to 2.5 wt % of the solids of the transparent electrostatic ink composition.

In some examples, the transparent electrostatic ink composition further includes, e.g. as a charge adjuvant, a salt of multivalent cation and a fatty acid anion. The salt of multivalent cation and a fatty acid anion can act as a charge adjuvant. The multivalent cation may, in some examples, be a divalent or a trivalent cation. In some examples, the multivalent cation is selected from Group 2, transition metals and Group 3 and Group 4 in the Periodic Table. In some examples, the multivalent cation includes a metal selected from Ca, Sc, Ti, V, Cr, Mn, Fe, Co, Ni, Cu, Zn, Al and Pb. In some examples, the multivalent cation is Al3+. The fatty acid anion may be selected from a saturated or unsaturated fatty acid anion. The fatty acid anion may be selected from a $C_8$ to $C_{26}$ fatty acid anion, in some examples a $C_{14}$ to $C_{22}$ fatty acid anion, in some examples a $C_{16}$ to $C_{20}$ fatty acid anion, in some examples a $C_{17}$, $C_{18}$ or $C_{19}$ fatty acid anion. In some examples, the fatty acid anion is selected from a caprylic acid anion, capric acid anion, lauric acid anion, myristic acid anion, palmitic acid anion, stearic acid anion, arachidic acid anion, behenic acid anion and cerotic acid anion.

The charge adjuvant, which may, for example, be or include a salt of multivalent cation and a fatty acid anion, may be present in an amount of 0.1 wt % to 5 wt % of the solids of the transparent electrostatic ink composition, in some examples in an amount of 0.1 wt % to 2 wt % of the solids of the transparent electrostatic ink composition, in some examples in an amount of 0.1 wt % to 2 wt % of the solids of the transparent electrostatic ink composition, in some examples in an amount of 0.3 wt % to 1.5 wt % of the solids of the transparent electrostatic ink composition, in some examples about 0.5 wt % to 1.2 wt % of the solids of the transparent electrostatic ink composition, in some examples about 0.8 wt % to 1 wt % of the solids of the transparent electrostatic ink composition, in some examples about 1 wt % to 3 wt % of the solids of the transparent electrostatic ink composition, in some examples about 1.5 wt % to 2.5 wt % of the solids of the transparent electrostatic ink composition.

Solid Polar Compound

The transparent electrostatic ink composition may further comprise a solid polar compound. In some examples, the solid polar compound is a solid (e.g., at room temperature, i.e., from about 20° C. to about 25° C.), colorless organic material. The solid organic material may be a polymeric material or a non-polymeric material. The solid polar compound may be an organic particle that is resistant to swelling or dissolving in a non-polar carrier fluid, e.g. an isoparaffinic fluid as described herein. The solid polar compound may be dispersed in the resin, and, in some examples, is present in an amount up to 60 wt. % of solids in the transparent electrostatic ink composition. The solid polar compound may be selected from the group consisting of a saccharide, polyacrylic acid, polyvinyl alcohol, styrene maleic anhydride, a bismaleimide oligomer, a cellulose derivative and an aliphatic urethane acrylate.

In some examples, the transparent electrostatic ink composition comprises a saccharide or a modified saccharide. In some examples, modified saccharides are acetylated saccharides. In some examples, the transparent electrostatic ink composition comprises a disaccharide or a modified disaccharide. In some examples, the transparent electrostatic ink composition comprises a saccharide or modified saccharide selected from maltose monohydrate, sucrose, sucrose octanoate, sucrose octaacetate, dextrin, xylitol and sucrose benzoate.

In some examples, the transparent electrostatic ink composition comprises a saccharide or a modified saccharide in an amount of greater than 15 wt % of the non-volatile solids in the electrostatic ink composition, for example, in an amount of greater than 20 wt % of the non-volatile solids in the transparent electrostatic ink composition, for example in an amount of greater than 25 wt % of the non-volatile solids in the transparent electrostatic ink composition, for example in an amount of greater than 30 wt % of the non-volatile solids in the transparent electrostatic ink composition. In some examples, the transparent electrostatic ink composition comprises a saccharide or a modified saccharide in an amount of less than 60 wt % of the non-volatile solids in the transparent electrostatic ink composition, for example less than 50 wt % of the non-volatile solids in the electrostatic ink composition, for example less than 45 wt % of the non-volatile solids in the transparent electrostatic ink composition, for example less than 40 wt % of the non-volatile solids in the transparent electrostatic ink composition.

In some examples, the saccharide is selected from the group consisting of maltose monohydrate, sucrose, sucrose octanoate, dextrin, xylitol, sucrose octaacetate, and sucrose benzoate. In some examples, the solid polar compound has a particle size from about 30 nm to about 300 nm.

Examples of commercially available styrene maleic anhydrides include copolymers from Sartomer Co. USA, LLC, such as SMA® 40001, SMA® 10001, and SMA® 1000P. Examples of cellulose derivatives include sodium carboxylmethyl cellulose and cellulose acetate propionate. A suitable example of a bismaleimide oligomer is bis-stearamide, and a suitable example of an aliphatic urethane acrylate is REAFREE® UV ND-2335 from Arkema, Spain. It is to be understood that these solid polar compounds are examples, and that any other organic material that includes polar atoms and is resistant to swelling or dissolving in a non-polar carrier fluid may be used.

Other Additives

The transparent electrostatic ink composition may include an additive or a plurality of additives. The additive or plurality of additives may be added at any stage of the method. The additive or plurality of additives may be selected from a wax, a surfactant, biocides, organic solvents, viscosity modifiers, materials for pH adjustment, sequestering agents, preservatives, compatibility additives, emulsifiers and the like. The wax may be an incompatible wax. As used herein, "incompatible wax" may refer to a wax that is incompatible with the resin. Specifically, the wax phase separates from the resin phase upon the cooling of the resin fused mixture on a print substrate during and after the transfer of the ink film to the print substrate, e.g. from an intermediate transfer member, which may be a heated blanket.

Target Substrate

The target substrate may be any suitable medium. The target substrate may be any suitable medium capable of having an image printed thereon. The target substrate may include a material selected from an organic or inorganic material. The material may include a natural polymeric material, e.g. cellulose. The material may include a synthetic polymeric material, e.g. a polymer formed from alkylene monomers, including, but not limited to, polyethylene and polypropylene, and co-polymers such as styrene-polybutadiene. The polypropylene may, in some examples, be biaxially orientated polypropylene. The material may include a metal, which may be in sheet form. The metal may be selected from or made from, for instance, aluminium (Al), silver (Ag), tin (Sn), copper (Cu), mixtures thereof. The metal may be an elemental metal or a metal in alloy form. The material may comprise wood or glass and may be in sheet form. In an example, the print medium includes a cellulosic paper. In an example, the cellulosic paper is coated with a polymeric material, e.g. a polymer formed from styrene-butadiene resin. In some examples, the cellulosic paper has an inorganic material bound to its surface (before printing with ink) with a polymeric material, wherein the inorganic material may be selected from, for example, kaolinite or calcium carbonate. The target substrate is, in some examples, a cellulosic print medium such as paper. The cellulosic print medium is, in some examples, a coated cellulosic print. In some examples, a primer may be coated onto the print medium, before the transparent electrostatic ink composition is printed onto the target substrate.

In some examples, the target substrate comprises a film or sheet of at least one of paper, metallic foil, and plastic. In some examples, the target substrate is transparent. In some examples, the target substrate comprises a metallized paper or a metallized plastic film. In some examples, the target substrate comprises an aluminium foil. In some examples the target substrate comprises a film of a plastic material, for example, polyethylene (PE), linear low density polyethylene (LLDPE), low density polyethylene (LDPE), polypropylene (PP), biaxially oriented polypropylene (BOPP). In some examples, the target substrate comprises a metallized paper in the form of a paper substrate coated on one surface with a layer of metal, for example aluminium. In some examples, the target substrate comprises a metallized plastic film in the form of a polymer substrate coated on one surface with a layer of metal, for example aluminium. In some examples, the target substrate comprises a metallized plastic film in the form of a metallized BOPP film, a metallized PET film, or a metallized polyethylene (PE) film.

In some examples, the target substrate comprises a film of material, wherein the film is less than 100 μm in thickness, for example less than 90 μm in thickness, less than 80 μm in thickness, less than 70 μm in thickness, less than 60 μm in thickness, less than 50 μm in thickness, less than 40 μm in thickness, less than 30 μm in thickness, less than 20 μm in thickness, less than 15 μm in thickness. In some examples, the film of material is about 12 μm in thickness.

In some examples, the target substrate comprises a film of material, wherein the film is greater than 12 μm in thickness, for example greater than 15 μm in thickness, greater than 20 μm in thickness, greater than 30 μm in thickness, greater than 40 μm in thickness, greater than 50 μm in thickness, greater than 60 μm in thickness, greater than 70 μm in thickness, greater than 80 μm in thickness, greater than 90 μm in thickness. In some examples, the film of material is about 100 μm in thickness.

In some examples, the target substrate comprises a fabric, for example a woven fabric, a knitted fabric or a non-woven fabric. A fabric may be a cloth made from yarn or fibres by weaving, knitting, felting or other techniques. In some examples, the target substrate comprises a fabric formed from yarns comprising material selected from polyester, polyamides, polyvinyl alcohols, lyocell, rayon, viscose, nylon, cotton, linen, flax, hemp, jute and wool, acetates, acrylic, elastane, silk or any combination thereof.

Transfer Material

The transfer material may be a material which conducts heat and on which the transparent electrostatic ink composition is electrostatically printed. The image layer is printed on the transfer material in reverse of how the image is to appear on the target substrate. The transfer material may also be referred to as the "label sheet" or the "ribbon". The transfer material may be a material that is different from the target substrate. For example, if the target substrate is or comprises a fabric, the transfer material may be a non-fabric material, e.g. a polymer film or a paper substrate.

The transfer material may be any suitable transfer medium for use in thermal transfer printing. The transfer material may be any suitable medium capable of having an image printed thereon. In some examples, the transfer material comprises a material selected from a polyester film (such as a polyethylene terephthalate (PET) film), a polyvinyl chloride (PVC) film and a polyethylene film.

The transfer medium may comprises an amorphous (non-crystalline) polyester, such as amorphous polyethylene terephthalate (APET).

In some examples, the transfer material is to allow good thermal transfer. In some examples, the transfer material comprises a film of material, wherein the film is less than 100 μm in thickness, for example less than 90 μm in thickness, less than 80 μm in thickness, less than 70 μm in thickness, less than 60 μm in thickness, less than 50 μm in thickness, less than 40 μm in thickness, less than 30 μm in thickness, less than 20 μm in thickness, less than 15 μm in thickness. The transfer material may be in the form of a sheet or film and/or may have a thickness of from 5 μm to 250 μm, in some examples from 5 μm to 100 μm, in some examples from 5 μm to 50 μm, in some examples 5 to 20 μm or in some examples from 100 μm to 250 μm.

The transfer material may comprise a plurality of layers, e.g. a layer comprising a material selected from a polyester film (such as a polyethylene terephthalate (PET) film), a polyvinyl chloride (PVC) film and a polyethylene film, and a further layer, which may be a primer layer, onto which the transparent electrostatic ink composition is printed.

The transfer material may include a material selected from an organic or inorganic material. The material may include a natural polymeric material, e.g. cellulose. The material may include a synthetic polymeric material, e.g. a polymer formed from alkylene monomers, including, but not limited to, polyethylene and polypropylene, and co-polymers such as styrene-polybutadiene. The polypropylene may, in some examples, be biaxially orientated polypropylene. The material may include a metal, which may be in sheet form. The metal may be selected from or made from, for instance, aluminium (Al), silver (Ag), tin (Sn), copper (Cu), mixtures thereof. In an example, the print medium includes a cellulosic paper. In an example, the cellulosic paper is coated with a polymeric material, e.g. a polymer formed from styrene-butadiene resin. In some examples, the cellulosic paper has an inorganic material bound to its surface (before printing with ink) with a polymeric material, wherein the inorganic material may be selected from, for example, kaolinite or calcium carbonate. The transfer material is, in some examples, a cellulosic print medium such as paper. The cellulosic print medium is, in some examples, a coated cellulosic print.

In one example, the transfer material comprises a film or sheet of at least one of paper, metallic foil, and plastic. In one example, the transfer material is transparent. In one example, the transfer material comprises a metallized paper or a metallized plastic film. In one example, the transfer material comprises an aluminium foil. In one example the transfer material comprises a film of a plastic material, for example, polyethylene (PE), linear low density polyethylene (LLDPE), low density polyethylene (LDPE), polypropylene (PP), biaxially oriented polypropylene (BOPP). In one example, the transfer material comprises a metallized paper in the form of a paper substrate coated on one surface with a layer of metal, for example aluminium. In one example, the transfer material comprises a metallized plastic film in the form of a polymer substrate coated on one surface with a layer of metal, for example aluminium. In one example, the transfer material comprises a metallized plastic film in the form of a metallized BOPP film, a metallized PET film, or a metallized polyethylene (PE) film.

Image Layer

The electrostatic ink composition on the transfer material has printed thereon an image, which may be said to form an image layer. The image layer may comprise a colorant selected from a black colorant, a magenta colorant, a yellow colorant and cyan colorant.

In some examples, the image or image layer is printed on the electrostatic ink composition on the transfer material in an electrostatic printing process using an electrostatic ink composition comprising a colorant, a thermoplastic resin and a charge director and/or a charge adjuvant. Any suitable colorant can be used, for example a pigment. The image or information may be reverse printed onto the target substrate.

In some examples, after printing the image layer, the target substrate is subjected to a corona treatment of the image layer prior to printing the transparent electrostatic ink composition, which may also improve bond strength. In some examples, at least one of the target substrate and substrate is subjected to a corona treatment, e.g. prior to any printing thereon, to improve bond strength.

Heat Transfer Printing

The image layer and the transparent electrostatic ink composition are transferred to the target substrate by heat transfer printing. This may involve contacting the image on the transfer material with a target substrate under conditions such that the thermoplastic resin of the transparent electrostatic ink composition is softened or molten, and separating the target substrate and the transfer material, to leave the target substrate having thereon the image and an overlying layer of transparent electrostatic ink composition. Heat and/or pressure may be applied to effect the softening and/or melting of the thermoplastic resin of the transparent electrostatic ink composition. The contacting may be carried out on a lamination apparatus or a pressure sealer, which are commercially available.

The contacting may be carried out at a suitable temperature to allow the thermoplastic resin to soften or become molten during the contacting. The suitable temperature may be a raised temperature, e.g. of 30° C. or above, in some examples 40° C. or above, in some examples 50° C. or above, in some examples 60° C. or above, 70° C. or above, 80° C. or above, in some examples 100° C. or above, in some examples 150° C. or above, in some examples 180° C. or above. The suitable temperature may be from 30° C. to 100° C., in some examples, in some examples 30° C. to 80° C. in some examples 30° C. to 70° C., in some examples 40° C. to 80° C. The suitable temperature may be from 50° C. to 250° C., in some examples from 60° C. to 220° C., in some examples from 90° C. to 210° C., in some examples from 90 to 130° C., in some examples from 100 to 110° C. The target substrate and the transfer material may be separated while the thermoplastic resin is softened or molten.

The temperature may be a temperature at or above the Vicat softening point of the resin, as measured using ASTM D1525. The temperature may be a temperature at or above the freezing point of the resin, as measured by Differential Scanning calorimetry under ASTM D3418. The temperature may be a temperature at or above the melting point of the resin, as measured by Differential Scanning calorimetry under ASTM D3418. Where a plurality of polymers are used in the resin, the softening point, freezing point or the melting point, may be measured on the blend of polymers.

The contacting may involve pressing the base material and the substrate between two members, at least one of which, in some examples both of which, is/are heated, e.g. to a temperature mentioned above. In some examples, the two members may be heated to the same temperature, e.g. to a temperature mentioned above. In some examples, the two members may be heated to different temperatures, e.g. one at a temperature of from 40° C. to 100° C., e.g. 40° C. to 70° C., and the other at a higher temperature, e.g. a temperature of 100° C. or more, e.g. a temperature of from 110° C. to 250° C., e.g. a temperature of from 110° C. to 150° C. In some examples, at least one of the members is heated to a temperature of 100° C. or above. The two members may be rollers, and may be part of a lamination apparatus. If the two members are rollers, the speed of passing the target substrate and the transfer material (having the transparent electrostatic image and the image there between) through the rollers may be a suitable speed to allow the resin of the transparent electrostatic ink composition to soften or melt. The speed may be at least 0.1 m/min, in some examples at least 0.5 m/min, in some examples at least 1 m/min. The speed may be at least 10 m/min or less, in some examples 5 m/min or less, in some examples 4 m/min or less, in some examples 3 m/min or less. The speed may be of from 0.1 m/min to 10 m/min, in some examples from 0.5 m/min to 5 m/min, in some examples 0.5 m/min to 4 m/min, in some examples 1 m/min to 3 m/min. The speed may be determined depending on the temperature of the rollers, with a higher temperature leading to faster softening or melting of the resin, allowing for a higher speed, since the contact time can be less.

In some examples, the target substrate comprises a polymer film, such as a polyethylene film, and the contacting the image with a target substrate under conditions such that the thermoplastic resin of the transparent electrostatic ink composition is softened or molten is contacting the image with a target substrate at from 60° C. to 120° C., such that the thermoplastic resin of the transparent electrostatic ink composition is softened or molten. In some examples, the target substrate comprises a fabric the contacting the image with a target substrate under conditions such that the thermoplastic resin of the transparent electrostatic ink composition is softened or molten is contacting the image with a target substrate at from 70° C. to 130° C., such that the thermoplastic resin of the transparent electrostatic ink composition is softened or molten. In some examples, the target substrate comprises a metalized film (for example an aluminium layer on a polymer film, such as polyethylene or polypropylene) and the contacting the image with a target substrate under conditions such that the thermoplastic resin of the transparent electrostatic ink composition is softened or molten is contacting the image with a target substrate at from 50 to 80° C., such that the thermoplastic resin of the transparent electrostatic ink composition is softened or molten.

Pressure may be applied to the transfer material and the target substrate during the contacting, e.g. at the temperatures mentioned above. The pressure may be a pressure of at least from 1 bar (100 kPa), in some examples at least 2 bar, in some examples from 1 bar to 20 bar, in some examples 2 bar to 10 bar, in some examples 2 bar to 5 bar, in some examples 5 bar to 10 bar.

The contacting under a raised temperature and, in some examples, under pressure, may be carried out for a suitable time period to effect adhesion, and the suitable time period may be selected at least 0.1 seconds, in some examples at least 0.2 seconds, in some examples at least 0.5 seconds, in some examples at least 0.8 seconds, in some examples at least 1 second, in some examples at least 1.2 seconds, in some examples at least 1.5 seconds, in some examples at least 1.8 seconds, in some examples at least 2 seconds. The suitable time may be from 0.1 seconds to 10 seconds, in some examples 0.5 seconds to 5 seconds.

Electrostatic Printing

The electrostatic printing of the transparent electrostatic ink composition may comprise forming a latent electrostatic image on a surface;

contacting the surface with the transparent electrostatic ink composition, such that at least some of the transparent electrostatic ink composition adheres to the surface to form a developed toner image on the surface, and transferring the toner image to a target substrate, in some examples via an intermediate transfer member. The transparent electrostatic ink composition during printing may comprise particles, which may be termed toner particles, the particles comprising the thermoplastic resin, and, in some examples, a charge adjuvant and/or a charge director.

The image may comprise an electrostatic ink composition comprising a colorant. The image may comprise a thermoplastic resin, and a charge adjuvant and/or a charge director to form an image layer. The thermoplastic resin, the charge adjuvant and/or the charge director of the electrostatic ink composition used to form the image may, each, independently, be the same as or different from the thermoplastic resin, the charge adjuvant and/or the charge director of the transparent electrostatic ink composition, and may be selected from the thermoplastic resin, the charge adjuvant and/or the charge director disclosed above in respect of the transparent electrostatic ink composition. The colorant of the electrostatic ink composition used to form the image may be selected from a black colorant, a magenta colorant, a cyan colorant and a yellow colorant.

The printing of the image may be carried out using an electrostatic printing process, e.g. using the same electrostatic printing apparatus used to print the transparent electrostatic ink composition on the transfer material. The electrostatic printing of the image may involve forming a further latent electrostatic image on a surface;

contacting the surface with an electrostatic ink composition comprising a colorant, such that at least some of the electrostatic ink composition comprising a colorant adheres to the surface to form a developed colorant-containing toner image on the surface, and transferring the toner image to the transparent electrostatic ink composition on the transfer material, in some examples via an intermediate transfer member.

The electrostatic printing of the transparent electrostatic ink composition and the overlying image on the transfer material may be carried out in a single pass, e.g. by printing the transparent electrostatic ink composition and the image together onto the transfer material, e.g. such that the image overlies the transparent electrostatic ink composition on the transfer material. In some examples, this may involve disposing the image (formed with an electrostatic ink composition comprising a colorant) first on an intermediate transfer member in an electrostatic printing process and then forming an overlying layer of transparent electrostatic ink composition on the image, and transferring the image and the layer of transparent electrostatic composition to the transfer material.

The surface on which the latent electrostatic image is formed may be on a rotating member, e.g. in the form of a cylinder. The surface on which the latent electrostatic image is formed may form part of a photo imaging plate (PIP). The contacting may involve passing the transparent electrostatic composition between a stationary electrode and a rotating member, which may be a member having the surface having a latent electrostatic image thereon or a member in contact with the surface having a latent electrostatic image thereon. A voltage is applied between the stationary electrode and the rotating member, such that the particles adhere to the surface of the rotating member. This may involve subjecting the transparent electrostatic ink composition to an electric field having a field gradient of 50-400V/μm, or more, in some examples 600-900V/μm, or more.

The intermediate transfer member may be a rotating flexible member, which is in some examples heated, e.g. to a temperature of from 80 to 160° C., in some examples from 90 to 130° C., in some examples from 100 to 110° C.

The electrostatic printing may be carried out so that a plurality of impressions or copies are carried out. The number of impressions or copies may be at least 10, in some examples at least 100, in some examples at least 1000, in some examples at least 5000. The print coverage on each print substrate in each impression may be 40% or less, in some examples 30% or less, in some examples 20% or less. An impression may be a single image of one colour formed on a print substrate. A copy may be a single image having a plurality of colours, e.g. selected from black, magenta, cyan and yellow.

The electrostatic printing may be carried out so that a plurality of target substrate sheets are printed, for example 10 or more target substrate sheets, in some examples 100 or more target substrate sheets, in some examples 500 or more target substrate sheets, in some examples 1000 or more target substrate sheets. The sheets may be any suitable size or shape, e.g. of standard printing size, such as A4 or A3.

EXAMPLES

The following illustrates examples of the methods and other aspects described herein. Thus, these Examples should not be considered as limitations of the present disclosure, but are merely in place to teach how to make examples of the present disclosure.

In the following examples, 'Isopar' is Isopar™ L Fluid, produced by ExxonMobil and having CAS Number 64742-48-9.

In the following examples, the resin used is Nucrel 699, available from DuPont, and A-C 5120, available from Honeywell, in a weight ratio of 4:1.

In the following examples, NCD indicates a natural charge director made of three components: KT (natural soya lecithin in phospholipids and fatty acids), BBP (basic barium petronate i.e. a barium sulfonate salt of a 21-26 hydrocarbon alkyl, supplied by Chemtura), and GT (dodecyl benzene sulfonic acid isopropyl amine, supplied by Croda). The composition being 6.6 wt % KT, 9.8 wt % BBP and 3.6 wt % GT, balance 80% Isopar.

In the following examples, SCD indicates a synthetic charge director, being a barium bis sulfosuccinate salt as described in US 2009/0311614 or WO2007130069. This is a strong negative charge director with strong base in the micelle core (barium phosphate) which enhances stable negative charge on ink particle. SCD is a charge director and in the absence of a dispersant) has been found to display very low low field charging (high charge partitioning).

Example 1

The transparent electrostatic ink comprised 73.14 g paste (an isoparaffinic non-polar carrier fluid with ethylene methacrylic acid copolymers and ethylene acrylic acid co-polymers dispersed therein, namely Nucrel 699 (DuPont) and A-C 5120 (Honeywell) in the ratio of 4:1 (wt:wt)). The paste contained 35 wt % resin solids (i.e. the combination of Nucrel 699 (DuPont) and A-C 5120 (Honeywell)), 35 wt % maltosemonohydrate (Fisher) and 1.0 wt % aluminum stearate (grinding aid material/charge adjuvantISigma Aldrich). The ink was ground using an attritor (S0 from union process USA) at 25° C. for 24 hours. The ink was diluted to 2 wt % solids in Isopar, charged by adding 8 ml of commercially available HP Indigo Imaging Agent (for use with HP Indigo 6000 series presses; Imaging Agent contains NCD, but SCD could be used) and left over-night prior to printing.

The transparent electrostatic ink composition was applied on PET using a HP Indigo 6600 liquid electrostatic printing system. The 12 micron thick PET (from Polyplex Corporation) substrate was treated by 1 kW Corona (mounted on the printing system) prior to printing. The electrostatic ink composition and the image were printed in the same pass. The image was printed on the top of the transparent electrostatic ink, which then served as a releasable layer. Thermal transfer to a polyethylene (PE 90 μm) target substrate was performed using a laboratory laminator (from GMP, model EXCELAM PLUS 355RM). The PE film (target substrate) was placed on the top of the image baring foil prior to thermal transfer of the image to the target substrate. The films were passed through the two heated roll laminator where the image bearing foil was heated by the top roll to 120° C.: the bottom film (PE) was heated to 50° C. by the bottom roll. The foil speed was 1.9 m/min.

The image from the image baring foil (i.e. the PET sheet) was transferred completely to the PE film.

Example 2

The electrostatic ink composition of Example 1 was printed using the Indigo 6600 printing system. The 12 micron thick PET (from Polyplex Corporation) substrate was treated by 1 kW Corona (mounted on the printing system) prior to printing. The transparent electrostatic ink composition and the image were printed in the same pass. The image was printed on the top of the transparent electrostatic ink composition, which served as a releasable layer. In this example the image was transferred to a fabric (Product code: P2008, 100% dip coating nylon taffeta two side coated, made in china, Product code: PN7702A9, Nylon/Polyester Blended Taffeta, Without Fluorescence, Two-Side Coated, made by: HUZHOU SINYLABEL MATERIAL CO., LTD). Thermal transfer was performed using a laboratory laminator (from GMP, model EXCELAM PLUS 355RM). The fabric (target substrate) was placed on the top of the image bearing foil prior to thermal transfer of the image to the target substrate. The films were passed through the two heated roll laminator where the image bearing foil was heated by the top roll to 104° C.: the bottom layer (fabric) was heated to 104° C. by the bottom roll. The foil speed was 1.9 m/min.

The image from the image baring foil (i.e. the PET sheet) was transferred completely to the fabric.

Example 3

The electrostatic ink composition of Example 1 was printed using Indigo 6600 printing system. The 12 micron thick PET (from Polyplex Corporation) substrate was treated by 1 kW Corona (mounted on the printing system) prior to printing. The transparent electrostatic ink composition and the image were printed in the same pass. The image was printed on the top of electrostatic ink composition that served as a releasable layer. Thermal transfer to the a aluminium foil target substrate (aluminum 15 μm (from Toplast)) was performed using a laboratory laminator (from GMP, model EXCELAM PLUS 355RM). The aluminum foil (target substrate) was placed on the top of the image baring foil (i.e. the PET bearing the transparent electrostatic ink composition and overlying electrostatically printed image) prior to thermal transfer of the image to the target substrate. The films were passed through the two heated roll laminator where the image bearing foil was heated by the top roll to 80° C.: the bottom film was heated to 80° C. by the bottom roll. The foil speed was 1.6 m/min.

The image from the image baring foil (i.e. the PET sheet) was transferred completely to the aluminum foil.

The Examples above illustrate the ease with which heat transfer printing may be carried out using the process as described herein. As can be seen, the transparent electrostatic ink composition first acts as an adhesive layer onto which the image can be printed, but then, when heated, it separates from the transfer membrane easily allowing the image to transfer well to the final substrate.

The target substrate has an image thereon and a protective overlying layer comprising the transparent electrostatic ink composition. The protective layer and the image can be formed using the same apparatus, e.g. electrostatic printing apparatus, rather than in two separate apparatus or different procedures.

Further, the present disclosure allows high productivity by printing the transparent electrostatic ink composition and the image in one pass, saving time and money.

While the process and related aspects have been described with reference to certain examples, those skilled in the art will appreciate that various modifications, changes, omissions, and substitutions can be made without departing from the spirit of the disclosure. It is intended, therefore, that the process and related aspects be limited by the scope of the following claims. The features of any dependent claim can be combined with the features of any of the other dependent claims, and any independent claim.

The invention claimed is:

1. A process for heat transfer printing, comprising:

electrostatically printing a transparent electrostatic ink composition onto a transfer material, wherein the transparent electrostatic ink composition comprises a thermoplastic resin;

printing an image on the transparent electrostatic ink composition;

contacting the image with a target substrate under conditions such that the thermoplastic resin of the transparent electrostatic ink composition is softened or molten, and separating the target substrate and the transfer material, to leave the target substrate having thereon the image and an overlying layer of transparent electrostatic ink composition;

wherein the transparent electrostatic ink composition further comprises a saccharide or a modified saccharide present in an amount of from 20 to 60 wt % of the non-volatile solids present in the transparent electrostatic ink composition.

2. The process for heat transfer printing according to claim 1, wherein the transparent electrostatic ink composition further comprises a charge director and/or a charge adjuvant.

3. The process for heat transfer printing according to claim 1, wherein the saccharide or modified saccharide is selected from the group consisting of maltose monohydrate, sucrose, sucrose octanoate, sucrose octaacetate, dextrin, xylitol, and sucrose benzoate.

4. The process for heat transfer printing according to claim 1, wherein the saccharide or modified saccharide is present in an amount of from 25 to 50 wt % of the non-volatile solids present in the transparent electrostatic ink composition.

5. The process for heat transfer printing according to claim 1, wherein a carrier liquid in the transparent electrostatic ink composition comprises an insulating, non-polar, non-aqueous liquid.

6. The process for heat transfer printing according to claim 1, wherein printing an image comprises electrostatically printing an image using an electrostatic ink composition comprising a thermoplastic resin, a colorant and a charge director and/or charge adjuvant.

7. The process for heat transfer printing according to claim 1, wherein the target substrate comprises a fabric.

8. The process for heat transfer printing according to claim 1, wherein the target substrate comprises a polymeric film.

9. The process for heat transfer printing according to claim 1, wherein the target substrate comprises a metal.

* * * * *